US006478059B1

(12) United States Patent
Chandler

(10) Patent No.: US 6,478,059 B1
(45) **Date of Patent: *Nov. 12, 2002**

(54) LIQUID CONTAINER HAVING NECK WITH STACKED ANNULAR SEALING SURFACES THEREON

(76) Inventor: Herman R. Chandler, 31 Shafor Cir., Dayton, OH (US) 45409-2337

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/546,240

(22) Filed: Apr. 10, 2000

(51) Int. Cl.[7] ..... B65B 3/00
(52) U.S. Cl. ..... 141/364; 141/367
(58) Field of Search ..... 141/346, 363, 141/364, 365, 366, 367, 378

(56) References Cited

U.S. PATENT DOCUMENTS

| | | | | | |
|---|---|---|---|---|---|
| 1,788,129 | A | | 1/1931 | Stephenson | |
| 1,961,033 | A | | 5/1934 | Bicks | 215/31 |
| D172,104 | S | | 5/1954 | Mayer | D58/6 |
| D175,676 | S | | 9/1955 | Funkey | D58/6 |
| 3,967,660 | A | * | 7/1976 | Russell | 141/95 |
| 4,239,130 | A | * | 12/1980 | Altadonna | 222/131 |
| 4,662,529 | A | | 5/1987 | Moore | 215/32 |
| D294,802 | S | | 3/1988 | Beaver | D9/375 |
| D295,372 | S | * | 4/1988 | Klette et al. | D9/349 |
| 4,877,142 | A | | 10/1989 | Doering | 215/1 C |
| D379,308 | S | | 5/1997 | Beaver | D9/523 |
| 5,634,504 | A | | 6/1997 | Chandler | 141/285 |
| D402,562 | S | | 12/1998 | Anderson et al. | D9/528 |
| D406,527 | S | | 3/1999 | Anderson et al. | D9/523 |

* cited by examiner

*Primary Examiner*—Steven O. Douglas
*Assistant Examiner*—Peter deVore
(74) *Attorney, Agent, or Firm*—Flanagan & Flanagan; John R. Flanagan

(57) ABSTRACT

A liquid container includes a container body defining an interior chamber for containing a liquid, a neck connected to the container body having a top defining a dispensing opening to allow passage of liquid from the interior chamber of the container body, and a plurality of annular sealing surfaces defined on the neck and being spaced from the top of the neck and protruding outwardly beyond the top of the neck. The annular sealing surfaces are stacked one above another and having respective diameters which become progressively greater going from an uppermost one of the annular sealing surfaces located nearest to the top of the neck to a lowermost one of the annular sealing surfaces located farthest from the top of the neck for making continuous contact with a corresponding one of a plurality of liquid reservoir filler open ends of different diameters that will receive the neck of the container body when the liquid is poured from the interior chamber of the container body through the neck and the dispensing opening thereof. The liquid container can further include a plurality of annular seals each attached on one of the annular sealing surfaces.

10 Claims, 2 Drawing Sheets

LIQUID CONTAINER HAVING NECK WITH STACKED ANNULAR SEALING SURFACES THEREON

BACKGROUND OF THE INVENTION

1. Field of the Invention

The present invention generally relates to liquid containers and, more particularly, is concerned with a liquid container having a neck with stacked annular sealing surfaces thereon.

2. Description of the Prior Art

Automobile engine compartments have become more compact over the years. A reduction in the size of an engine compartment limits the available space around an engine oil filler open end, which has made it difficult for many automobile users to lower a container of motor oil to a normal pouring position without a considerable amount of oil spillage taking place on the engine around the oil filler open end.

The inventor herein was first to recognize that a fracture pattern on a container seal has a dual function. First, it permits automatic adjustment of the internal pressure of the container to the pressure of the atmosphere by allowing air to be exchanged through holes cut therein. Second, it retains the integrity of the seal by allowing liquid stored in the container to pass through the holes only at a rate which provides sufficient time for a user to place an uncapped inverted container over a filler open end for reception of the container's contents before drops of the liquid begin to seep out through the perforations of the fracture pattern. The seal may then be ruptured by the user squeezing the opposite sides of the container and thereby forcing liquid through the fracture pattern. For such recognition, the inventor herein was issued U.S. Pat. No. 5,634,504 which discloses a venting and flow control closure device that has a repeating vented fracture pattern for the dispensing opening of a liquid container. The repeating nature of the fracture pattern does not require precision indexing in the cap installation process and thereby reduces the complexity and cost of the seal installation process.

While the device of U.S. Pat. No. 5,634,504 appears to be satisfactory in use for the purpose for which it was designed, the inventor herein has determined that a need remains for an improvement of the designs of liquid container necks toward providing a more effective seal with oil filler open ends of engine oil reservoirs when oil is being poured from the liquid container. Also, a need exists for a solution which is more comprehensive in nature which may be used with oil filler open ends of different sizes.

SUMMARY OF THE INVENTION

The present invention provides a liquid container having a neck with stacked annular sealing surfaces thereon designed to satisfy the aforementioned need. One of the stacked annular sealing surfaces on the neck of the container makes continuous contact with a corresponding liquid filler open end of a liquid reservoir, such as an automobile engine oil reservoir, when the liquid of the container is being poured from the container and thereby provides a more effective seal between the container neck and the liquid filler open end. The stacked annular sealing surfaces have different diameter sizes for use with liquid reservoir filler open ends of different sizes and thereby provide a more comprehensive solution. By incorporating the sealing feature, damaging foreign material such as blowing sand is prevented from entering the filler opening and the ensuing damage is eliminated. The sealing feature also prevents toxic fumes from passing out of the fluid filler open end to be inhaled by the user while holding the draining container.

Accordingly, the present invention is directed to a liquid container which comprises: (a) a container body defining an interior chamber for containing a liquid; (b) a neck having an upper portion and a lower portion connected to the container body, the upper portion of the neck defining an opening to allow passage of the liquid from the interior chamber of the container body and having means for fastening a closure on the neck over the opening so as to close the opening to prevent leakage of the liquid from the interior chamber of the container body, the fastening means extending about and protruding outwardly from the upper portion of the neck; and (c) a plurality of annular sealing surfaces defined on the lower portion of the neck below the fastening means on the upper portion of the neck and extending about the neck and protruding outwardly from the neck beyond the fastening means, the annular sealing surfaces being stacked one above another and having respective sizes which become progressively greater going from an uppermost one of the annular sealing surfaces located nearest to the fastening means to a lowermost one of the annular sealing surfaces located farthest from the fastening means for making continuous contact with a corresponding one of a plurality liquid reservoir filler open ends of different sizes that can receive the neck when the liquid is poured from the interior chamber of the container body through the neck and the opening thereof.

More particularly, each of the annular sealing surfaces has a substantially circular and flat configuration. The liquid container further may comprise a plurality of annular seals each attached to one of the annular sealing surfaces. Each of the annular seals is made of a substantially flexible material, protrudes vertically from the respective one of the annular sealing surfaces, and has a substantially circular circumferential configuration and a substantially semi-circular cross-sectional configuration. Also, each of the annular sealing surfaces and the annular seals has a radial width. The radial width of one of the annular seals being less than or substantially the same as the radial width of the corresponding one of the annular sealing surfaces.

The present invention is also directed to a liquid container which comprises: (a) a container body defining an interior chamber for containing a liquid; (b) a neck connected to the container body and having a top defining an opening to allow passage of the liquid from the interior chamber of the container body; and (c) a plurality of alternating and interconnected vertical and horizontal walls provided on the neck below the top thereof and being of annular configuration and forming a plurality of lands stacked one above another with the horizontal walls thereof facing upwardly toward and protruding outwardly beyond the top of the neck such that the horizontal walls have respective sizes which become progressively greater going from an uppermost one of the lands located nearest to the top of the neck to a lowermost one of the lands located farthest from the top of the neck for making continuous contact with a corresponding one of a plurality of liquid reservoir filler open ends of different sizes that can receive the neck when liquid is poured from the interior chamber of the container body through the neck and the top opening thereof.

The present invention is also directed to a method of temporarily forming a seal between a neck of a liquid container and a liquid reservoir filler open end during pouring of liquid from the liquid container. The method comprises the steps of: (a) providing a liquid container having a neck with a dispensing opening and a plurality of annular sealing surfaces defined about the neck of the liquid container and stacked one above the other and being progressively greater in diameter going from an uppermost one of the annular sealing surfaces located nearest to the dispensing opening to a lowermost one of the annular sealing surfaces located farthest from the dispensing opening; and (b) inverting the liquid container so as to insert the neck thereof into a respective liquid reservoir filler open end having a diameter corresponding to the diameter of one of the annular sealing surfaces on the neck in order to pour the liquid from the liquid container through the neck and the dispensing opening thereof such that the neck of the liquid container seeks a maximum degree of penetration into the liquid reservoir filler open end until the penetration is terminated when the corresponding one of the annular sealing surfaces on the neck of the liquid container comes into contact with the liquid reservoir filler open end and thereby forms a temporary seal between the liquid reservoir filler open end and the corresponding one of the annular sealing surfaces on the neck of the liquid container.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
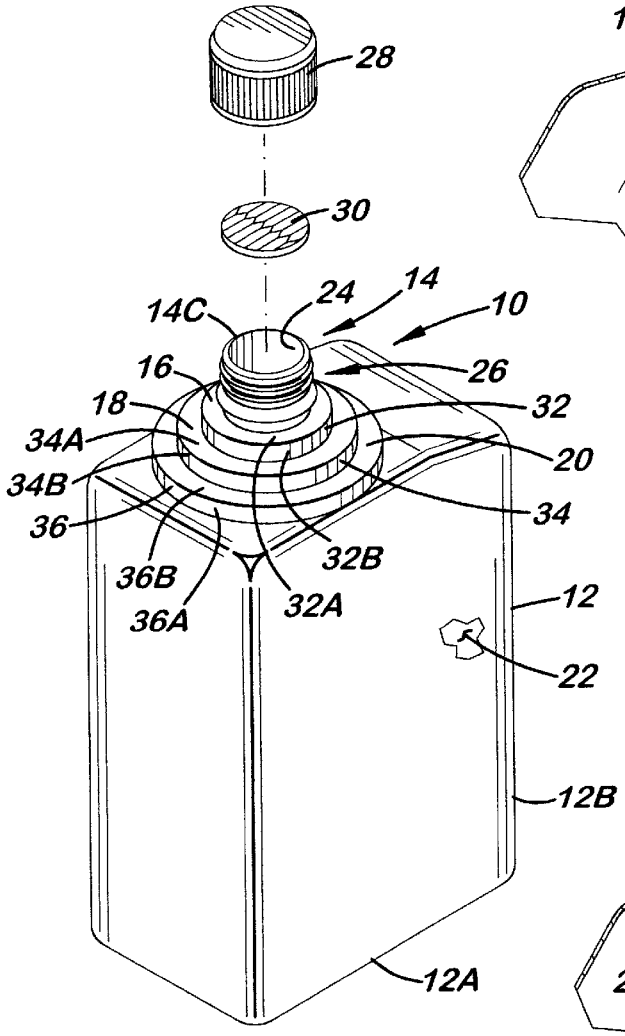
FIG. 1 is a perspective view of a first embodiment of a liquid container having a neck with a plurality of stacked annular sealing surfaces defined thereon in accordance with the present invention and also showing the patented venting and flow control closure device which seals onto an annular rim forming a dispensing opening of the container and a screw cap which fits over the closure device and screws onto the annular rim of the container.
Figure 2:
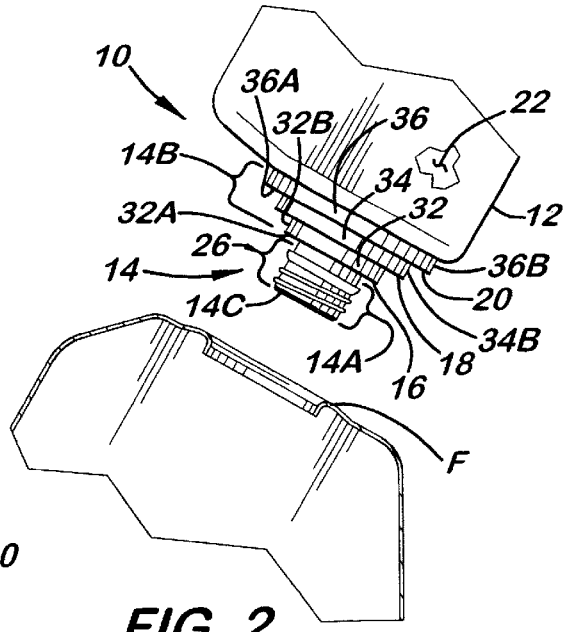
FIG. 2 is an enlarged fragmentary view of the liquid container neck of FIG. 1 before its insertion into a liquid filler open end of a reservoir.
Figure 3:
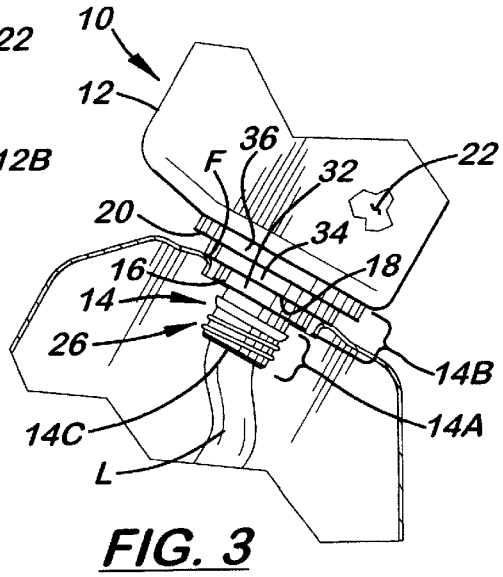
FIG. 3 is an enlarged fragmentary view of the liquid container neck of FIG. 1 after its insertion into the liquid filler open end of the reservoir and showing one of its annular sealing surfaces making a temporary seal with the liquid filler open end.

Referring to the drawings and particularly to FIGS. 1 to 3, there is illustrated a liquid container, generally designated 10, of the present invention. The container 10 basically includes a container body 12 for holding a liquid L, a neck 14 connected on the container body 12, and a plurality of annular sealing surfaces 16, 18, 20 defined on the neck 14 one above another in a stacked relationship.

The container body 12, having any suitable configuration and a one-piece construction, has a closed bottom end 12A and a continuous sidewall 12B integrally connected to and extending from the closed bottom end 12A and together therewith defines an interior chamber 22 for containing a liquid (not shown) The liquid, for example, may be an automotive engine oil or other liquids. The neck 14 has a substantially tubular configuration and an upper portion 14A and a lower portion 14B integrally connected to the continuous sidewall 12B of the container body 12. The upper portion 14A of the neck 14 terminates at a top rim 14C of the neck 14 which defines a dispensing opening 24 that constitutes the only means on the liquid container to allow passage of the liquid from the interior chamber 22 of the container body 12 to exteriorly of the liquid container 10. The upper portion 14A of the neck 14 has a suitable means 26 for fastening a closure, such as an internally threaded cap 28, on the neck 14 over the dispensing opening 24 thereof so as to close the dispensing opening 24 to prevent leakage of the liquid from the interior chamber 22 of the container body 12 to exteriorly of the liquid container 10. In the illustrated exemplary form, the fastening means 26 takes the form of external threads which extend about and protrude outwardly from the upper portion 14A of the neck 14, Also, as seen in FIG. 1, a venting and flow control closure device 30 can be attached over the top rim 14C of the neck 14. The device 30 can advantageously take the form of the one illustrated and described in aforementioned U.S. Pat. No. 5,634,504 which issued to the inventor herein.

The annular sealing surfaces 16, 18, 20 are defined on the lower portion 14B of the neck 14 below the fastening means 26 on the upper portion 14A of the neck 14. The annular sealing surfaces 16, 18, 20 extend about the neck 14 and protrude outwardly beyond the fastening means 26 on the upper portion 14A of the neck 14. The annular sealing surfaces 14, 16, 18 are stacked one above another and have respective sizes, specifically diameters, that become progressively greater going from the uppermost one 16 of the annular sealing surfaces 16, 18, 20 located nearest to the fastening means 26 to the lowermost one 20 of the annular sealing surfaces 16, 18, 20 located farthest from the fastening means 26. Given their arrangement and differing sizes (diameters), one of the annular sealing surfaces 16, 18, 20 as seen in FIG. 3 is capable of making continuous contact with a corresponding given one liquid reservoir filler open end F, of a plurality thereof of different sides, that can receive the neck 14 of the container body 12 when the liquid is poured from the interior chamber 18 of the container body 12 through the neck 14 and dispensing opening 24 thereof into a reservoir R.

Although three are shown, the annular sealing surfaces 16, 18, 20 can be any desired practical number and, as mentioned above, are stacked in relation to one another. Each annular sealing surface 16, 18, 20 has a substantially circular and flat configuration. The liquid reservoir filler open end F likewise generally has a substantially circular and flat configuration which can make flush contact with one of the annular sealing surfaces 16, 18, 20 of corresponding size.

The plurality of annular sealing surfaces 16, 18, 20 are, more particularly, formed by a plurality of lands 32, 34, 36 defined by a plurality of alternating and interconnected vertical and horizontal walls 32A, 32B, 34A, 34B and 36A, 36B that protrude outwardly beyond the fastening means 28 on the upper portion 14A of the neck 14. The horizontal wall 32A, 34A, 36A of each land 32, 34, 36 makes the continuous contact with the liquid filler open end F of the corresponding size when the neck 14 is received therethrough. The lands 32, 34, 36 also are in a stacked relationship to one another with the horizontal walls 32A, 34A, 36A of the lands 32, 34, 36 having the substantially circular and flat configurations and constituting the respective annular sealing surfaces 16, 18, 20. The vertical walls 32B, 34B, 36B of the lands 32, 34, 36 are disposed in substantially perpendicular relation to the horizontal walls 32A, 34A, 36A thereof and interconnect the outer and inner edges of the horizontal walls 32A, 34A, 36A going from the outermost to innermost lands 32, 34, 36. As readily seen in FIGS. 1–3, the outer and inner edges of the each of the horizontal walls 32A, 34A, 36A define therebetween the respective width of the horizontal wall. Also, each of vertical walls 32B, 34B, 36B has a respective height defined between adjacent ones of the horizontal walls 32A, 34A, 36A. The respective widths of the horizontal walls are equal to or greater than the respective heights of the vertical walls.

Referring to FIGS. 2 and 3, one can easily realize and understand the steps involved in the method of the present invention of temporarily forming a seal between the neck 14 of the container 10 and the liquid reservoir filler open end F during pouring of the liquid L from the liquid container 10. The liquid container 10 of the above-described construction is inverted to the position shown in FIG. 2 and then moved to the position shown in FIG. 3 so as to insert the neck 14 thereof into the liquid reservoir filler open end F which has a diameter corresponding to the diameter of one of the annular sealing surfaces 16, 18, 20 on the neck 14 in order to pour the liquid L from the liquid container 10 through the neck 14 and the dispensing opening 24 thereof. The insertion of the neck 14 of the liquid container 10 is such that the neck 14 seeks its maximum degree of penetration into the liquid reservoir filler open end F until the penetration is terminated when the corresponding one 18 of the annular sealing surfaces 16, 18, 20 on the neck 14 of the liquid container 10 comes into contact with the liquid reservoir filler open end F and thereby forms the temporary seal, as shown in FIG. 3, between the liquid reservoir filler open end F and the corresponding one annular sealing surface 18 on the neck 14 of the liquid container 10.

Figure 4:
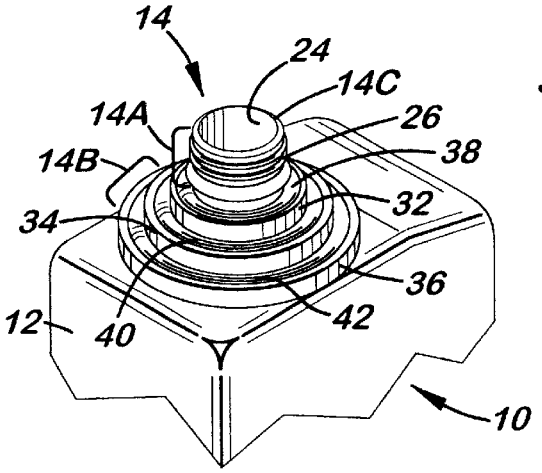
FIG. 4 is a fragmentary perspective view of a first alternative embodiment of the liquid container neck showing annular sealing rings of a first configuration applied on the stacked annular sealing surfaces of the container neck.
Figure 5:
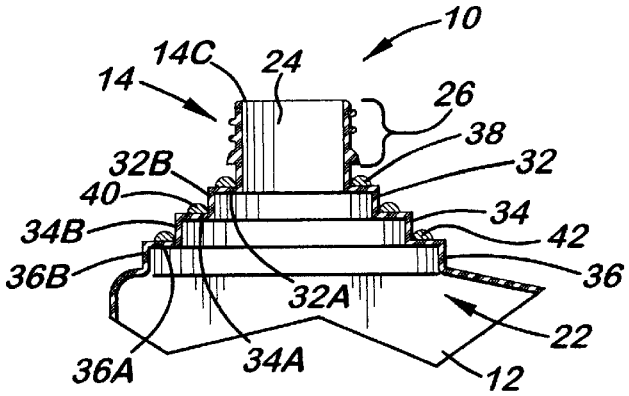
FIG. 5 is a fragmentary longitudinal sectional view of the liquid container neck of FIG. 4.
Figure 6:
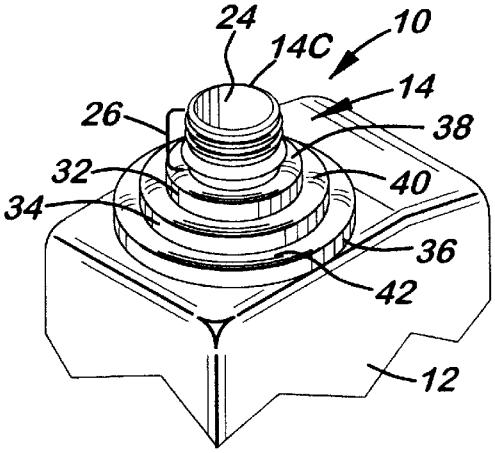
FIG. 6 is a fragmentary perspective view of a second alternative embodiment of the liquid container neck showing annular sealing rings of a second configuration applied on the stacked annular sealing surfaces of the container neck.
Figure 7:
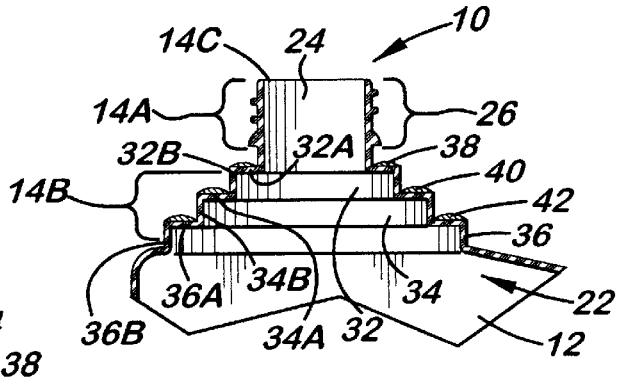
FIG. 7 is a fragmentary longitudinal sectional view of the liquid container neck of FIG. 6.

Referring to FIGS. 4 to 7, the liquid container 10 also includes at least one and, preferably, a plurality of annular seals 38, 40, 42. Each annular seal 38, 40, 42 is attached to one of the annular sealing surfaces 16, 18, 20 or, more particularly, to one of the horizontal walls 32A, 34A, 36A of the lands 32, 34, 36. Each annular seal 38, 40, 42 is made of a substantially yieldable and flexible material, such as used in 0-ring seals, and vertically protrudes above the respective horizontal walls 32A, 34A, 36A and preferably has a substantially circular circumferential configuration and a substantially semi-circular cross-sectional configuration. The radial widths of the annular seals 38, 40, 42 may be less than the radial widths of the corresponding horizontal walls 32A, 34A, 36A, as seen in FIGS. 4 and 5, or substantially the same as the radial widths of the horizontal walls 32A, 34A, 36A, as seen in FIGS. 6 and 7. The annular seal 38, 40, 42 on the corresponding one of the annular sealing surfaces 16, 18, 20 or lands 32, 34, 36 will make the temporary continuous sealing contact with the one liquid reservoir filler open end F when the neck 14 is inserted therethrough to its maximum penetration.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A liquid container, comprising:

(a) a container body having a closed bottom end and a continuous sidewall integrally connected to and extending from said closed bottom end and together therewith defining an interior chamber for containing a liquid;

(b) a neck integrally connected to said continuous sidewall of said container body such that said container body and neck have a one-piece construction, said neck having a top defining a dispensing opening that constitutes the only means on said liquid container to allow passage of the liquid from said interior chamber of said container body to exteriorly of said liquid container; and (c) a plurality of alternating and interconnected vertical and horizontal walls provided on said neck below said top thereof and being of annular configuration and forming a plurality of lands stacked one above another with said horizontal walls thereof facing upwardly toward and protruding outwardly beyond said top of said neck such that said horizontal walls have respective diameters which become progressively greater going from an uppermost one of said lands located nearest to said top of said neck to a lowermost one of said lands located farthest from said top of said neck for making continuous contact with a corresponding one of a plurality of liquid reservoir filler open ends of different diameters that can receive said neck of said container body when the liquid is poured from said interior chamber of said container body through said neck and said opening thereof to exteriorly of said liquid container, said horizontal walls having outer and inner edges defining therebetween respective widths of said horizontal walls, each of said vertical walls being disposed between and interconnecting said outer edge of one of said horizontal walls with said inner edge of another of said horizontal walls adjacent to said one horizontal wall, said vertical walls having respective heights defined between said adjacent horizontal walls, said respective widths of said horizontal walls being equal to or greater than said respective heights of said vertical walls.

2. The container of claim 1 wherein said horizontal walls of said lands have substantially circular and flat configurations.

3. The container of claim 1 wherein said horizontal walls of said lands have diameters which become progressively greater going from said uppermost one of said lands to said lowermost one thereof for making continuous contact with the corresponding one of the liquid reservoir filler open ends of different sizes.

4. The container of claim 1 wherein said vertical walls of said lands have cylindrical configurations.

5. The container of claim 1 further comprising:

a plurality of annular seals each made of a substantially flexible material and attached on said horizontal wall of one of said lands.

6. The container of claim 5 wherein each of said annular seals protrudes vertically from said horizontal wall of said one of said lands.

7. The container of claim 5 wherein each of said annular seals has a substantially circular circumferential configuration.

8. The container of claim 5 wherein each of said annular seals has a substantially semi-circular cross-sectional configuration.

9. The container of claim 5 wherein each of said horizontal walls and said annular seals has a radial width with said radial width of each of said annular seals being less than said radial width of said horizontal wall to which said each annular seal is attached.

10. The container of claim 5 wherein each of said horizontal walls and said annular seals has a radial width with said radial width of each of said annular seals being about the same as said radial width of said horizontal wall to which said each annular seal is attached.

* * * * *